US008360128B2

(12) United States Patent
Kinugasa et al.

(10) Patent No.: US 8,360,128 B2
(45) Date of Patent: Jan. 29, 2013

(54) TRANSFER TOOL

(75) Inventors: Shuji Kinugasa, Osaka (JP); Hideto Shima, Kyoto (JP); Keiji Kai, Osaka (JP)

(73) Assignee: Kokuyo Co., Ltd., Osaka-Shi, Osaka (JP)

( * ) Notice: Subject to any disclaimer, the term of this patent is extended or adjusted under 35 U.S.C. 154(b) by 520 days.

(21) Appl. No.: 12/149,820

(22) Filed: May 8, 2008

(65) Prior Publication Data

US 2009/0025884 A1 Jan. 29, 2009

(30) Foreign Application Priority Data

Jul. 27, 2007 (JP) ..... P2007-196635

(51) Int. Cl.
*B32B 37/26* (2006.01)
*B26F 3/02* (2006.01)
*B43L 19/00* (2006.01)

(52) U.S. Cl. ..... 156/577; 156/527; 118/76; 118/200; 118/527; 242/588; 242/588.3; 242/588.6; 242/160.2; 242/160.4; 242/170; 242/171; 206/411

(58) Field of Classification Search ..... 156/523, 156/527, 538, 574, 577, 579; 118/76, 200, 118/257; 225/46; 206/411; 242/160.2, 160.4, 242/170, 171, 588, 588.2, 588.3, 588.6
See application file for complete search history.

(56) References Cited

U.S. PATENT DOCUMENTS

| | | | | |
|---|---|---|---|---|
| 3,689,004 | A * | 9/1972 | Martin et al. | 242/375.2 |
| 4,434,952 | A * | 3/1984 | Czerwinski et al. | 242/375.2 |
| 6,418,997 | B1 * | 7/2002 | Tamai et al. | 156/577 |
| 6,422,284 | B1 | 7/2002 | Kelders et al. | |
| 7,900,679 | B2 * | 3/2011 | Kinugasa et al. | 156/577 |
| 7,963,309 | B2 * | 6/2011 | Simmelsgaard et al. | 156/577 |
| 2003/0056906 | A1 * | 3/2003 | You | 156/577 |
| 2006/0244558 | A1 | 11/2006 | Kinugasa et al. | |
| 2007/0113987 | A1 * | 5/2007 | Ushijima | 156/577 |

FOREIGN PATENT DOCUMENTS

| | | |
|---|---|---|
| EP | 1 717 180 A1 | 11/2006 |
| JP | 2003-54190 | 2/2003 |
| JP | 2003-54190 A | 2/2003 |
| WO | WO 99/23022 | 5/1999 |

* cited by examiner

*Primary Examiner* — Mark A Osele
(74) *Attorney, Agent, or Firm* — McGinn IP Law Group, PLLC

(57) ABSTRACT

A transfer tool of the present invention comprises a transfer head which has a folding back guide portion for folding and guiding a transfer tape and a pair of outer walls for supporting side ends of the folding back guide and in which a transfer tape passage is formed between the outer walls, a refill for holding at least the transfer head, a case capable of holding the refill such that the refill can be inserted into and pulled out from the case in one direction, and a head cap which is pivotally mounted on the case through a pivot shaft portion and rotatable between a close position where the transfer head is covered and an open position where the transfer head is exposed, wherein the head cap is located outside an inserting and pulling out locus of the transfer head when the head cap is disposed in the close position.

20 Claims, 10 Drawing Sheets

TRANSFER TOOL

BACKGROUND OF THE INVENTION

1. Field of the Invention

The present invention relates to a transfer tool having a case member including a head cap rotatable between a close position where a transfer surface side of a transfer head is covered and an open position where a surface of the head cap is opposed to or abuts against a case member body.

2. Background of the Related Art

Conventionally, in a transfer tool in which a transfer tape supplied from a supply reel rotatable around a spindle is wound around a winding reel through a transfer head rotatable, a structure having a head cap capable of covering the transfer head at a refill which holds the supply reel, the transfer head and the winding reel is used widely. In the transfer tool having such a structure, s standing plate which is opposed to a side plate of the transfer head is provided on each of both end edges of the head cap in its widthwise direction, and a holding mechanism is provided between the standing plate and the side plate such that the head cap can be held in a close position (see Japanese Patent Application Laid-open No. 2003-54190 for example).

To reduce the amount of waste when the refill is to be disposed, it is conceived to provide the head cap on the side of the case member. However, when the structure of the head cap described in Japanese Patent Application Laid-open No. 2003-54190 is employed, the head and the standing plate of the head cap interfere with each other when a refill is mounted in a state where the head cap is disposed on the side of the close position, it is necessary to retract the head cap toward the open position when the mounting operation of the refill is carried out, and there is a problem that some people feel it troublesome to mount the refill.

SUMMARY OF THE INVENTION

The present invention is for solving this problem.

That is, the present invention provides a transfer tool including a transfer head which has a folded-back guide for folding and guiding a transfer tape and a pair of outer walls for supporting side ends of the folded-back guide and which forms a transfer tape inserting passage between the outer walls, a refill for holding at least the transfer head, a case capable of holding the refill such that the refill can be inserted into and pulled out from the case from one direction, and a head cap which is pivotally mounted on the case through a pivot shaft and which can turn between a close position where the transfer head is covered and an open position where the transfer head is exposed, wherein the head cap is located outside an inserting and pulling out locus of the transfer head when the head cap is disposed in the close position.

According to this structure, even when the head cap is disposed in the close position, since the head cap is located outside the inserting and pulling out locus of the transfer head, it is possible to prevent the transfer head and the head cap from interfering with each other when a refill is attached or detached. Thus, labor for retracting the head cap toward the open position can be omitted. That is, it is possible to more easily mount the refill.

To prevent the transfer head from being exposed outside immediately after the refill is mounted on a case, such a transfer tool may further include a holding mechanism for elastically urging the head cap toward the close position. With this structure, the head cap can be held in the close position in a state where the head cap is elastically urged toward the close position.

If the holding mechanism is provided in the vicinity of the pivot shaft portion of the head cap, it is unnecessary to provide a constituent part of the holding mechanism on the side of the transfer head, and it is possible to easily share the design of the transfer head or the refill with other type of transfer head.

To enhance the outward appearance of the head cap and to reduce the entire transfer tool having such a head cap in size, the transfer tool may further include a head accommodating recess portion which can accommodate the folding back guide portion of the transfer head when head cap is disposed in the close position. With this structure, if the folding back guide portion of the transfer head is accommodated in the head accommodating recess portion, it is possible to prevent the folding back guide portion of the transfer head and the head cap from interfering with each other, and bring the head cap and the transfer head close to each other when the head cap is disposed in the close position.

To more effectively cover the transfer head in the close position, the transfer tool may further include a wall body which is provided on the opposite side in a pulling-out direction of the head cap and which is superposed on one of the outer walls that is located on the opposite side in a pulling-out direction of the transfer head.

According to the structure of the transfer tool of the present invention, even when the head cap is disposed in the close position, since the head cap is located outside the inserting and pulling out locus of the transfer head, it is possible to prevent the transfer head and the head cap from interfering with each other when a refill is attached or detached. Thus, labor for retracting the head cap toward the open position can be omitted. That is, it is possible to more easily mount the refill.

DETAILED DESCRIPTION OF THE PREFERRED EMBODIMENTS

An embodiment of the present invention will be explained with reference to the drawings.

Figure 1:
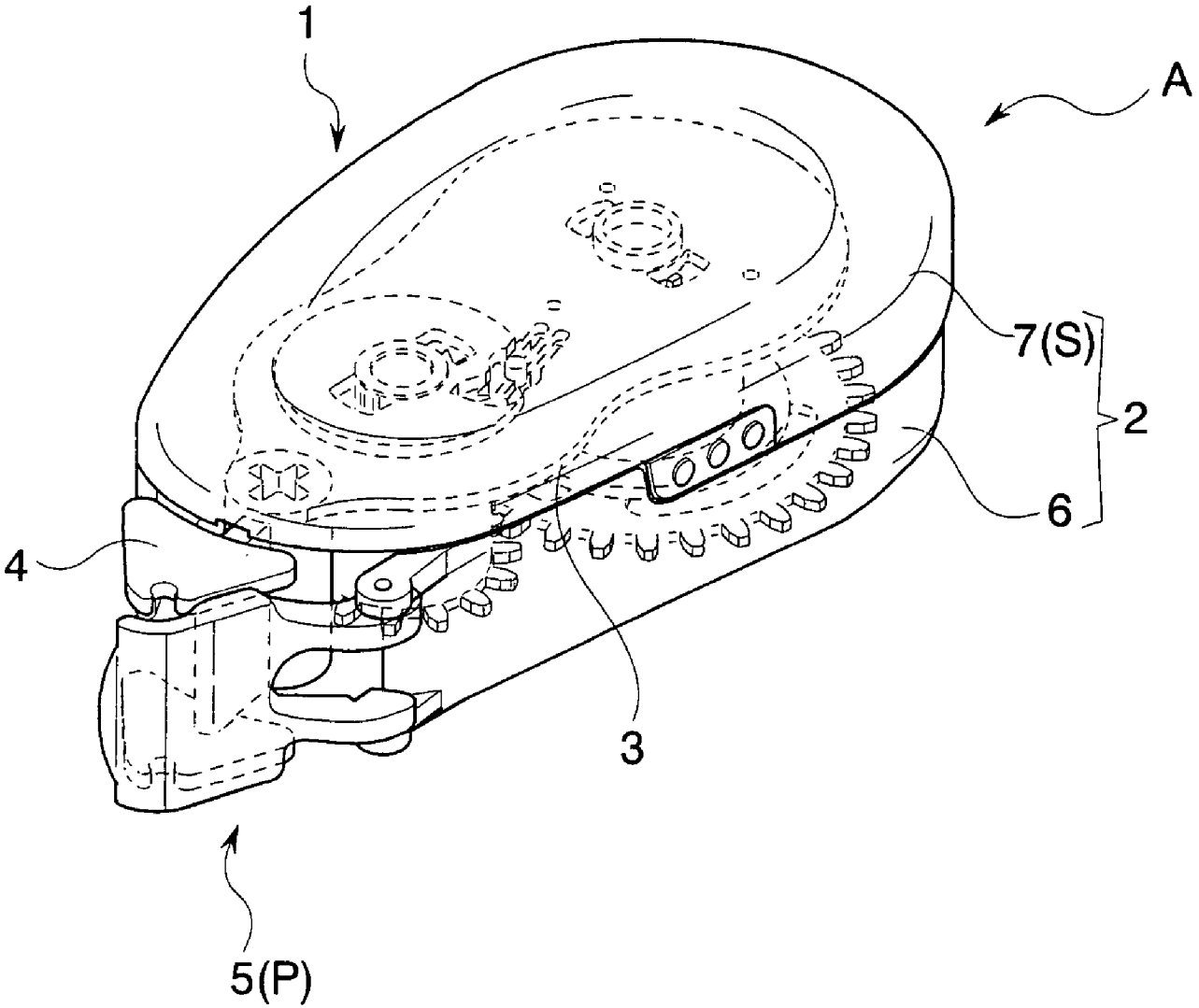
FIG. 1 is a perspective view of a state where a head cap of a transfer tool according to an embodiment of the present invention is disposed in a close position.
Figure 2:
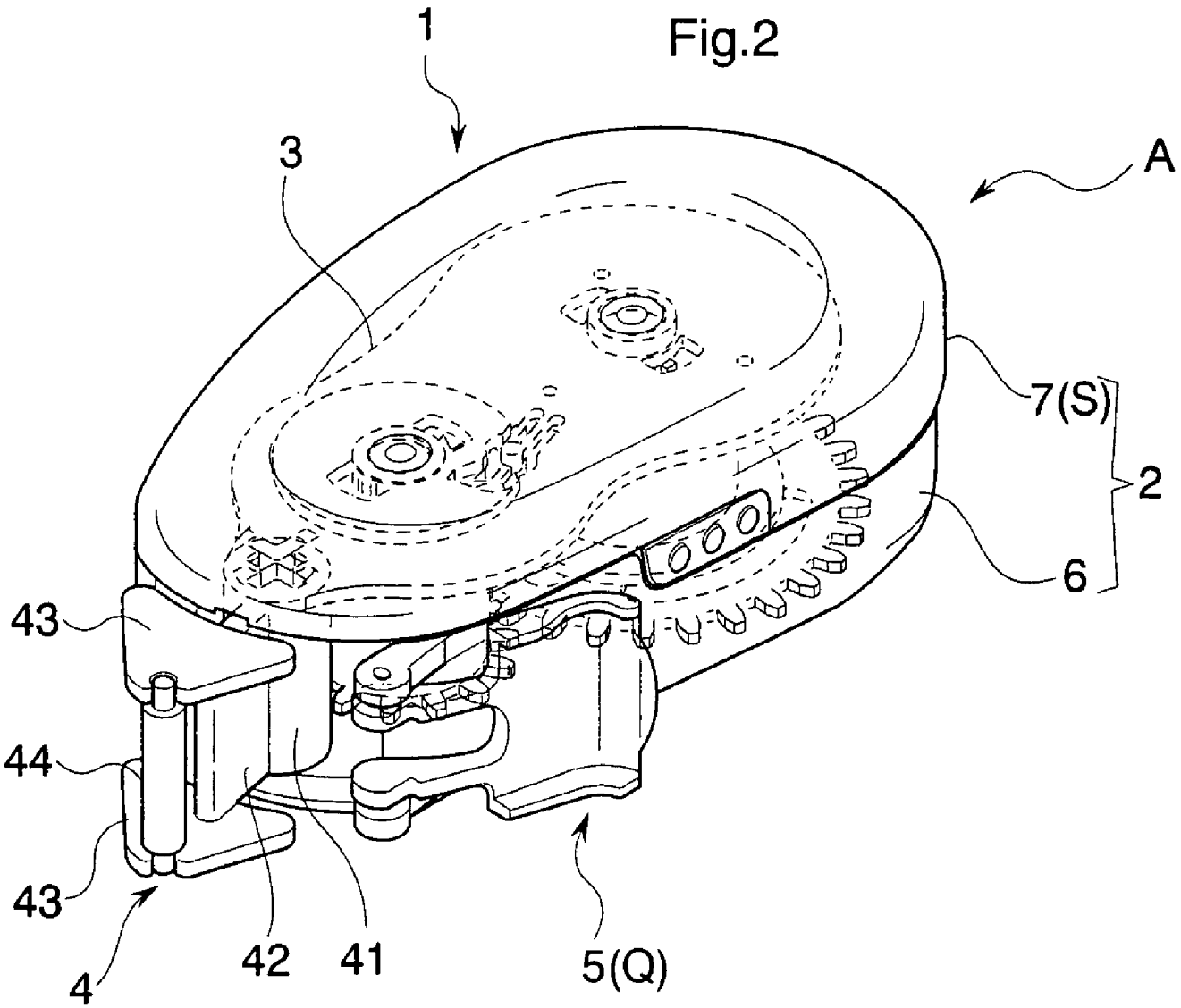
FIG. 2 is a perspective view of a state where the head cap of the transfer tool of the embodiment is disposed in an open position.
Figure 3:
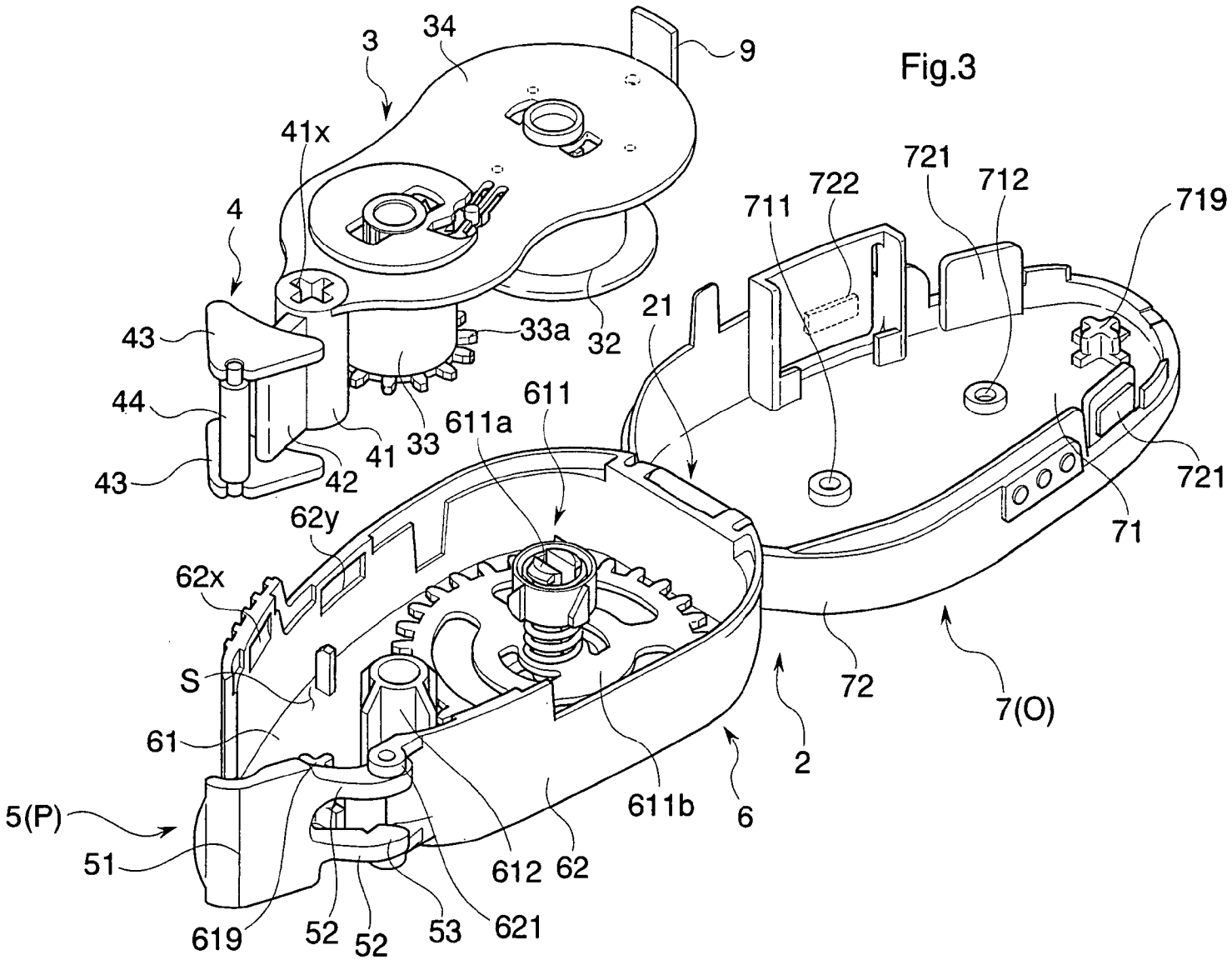
FIG. 3 is an exploded perspective view of the transfer tool of the embodiment.
Figure 4A:
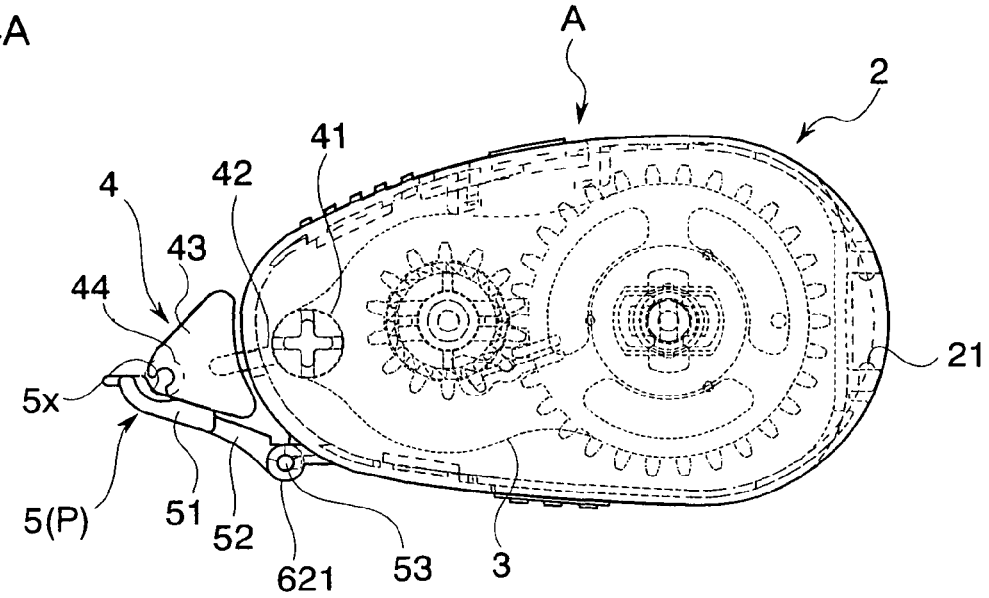
FIGS. 4A, 4B, and 4C are a side view, a bottom view and a central vertical sectional of the transfer tool of the embodiment, respectively.
Figure 4B:
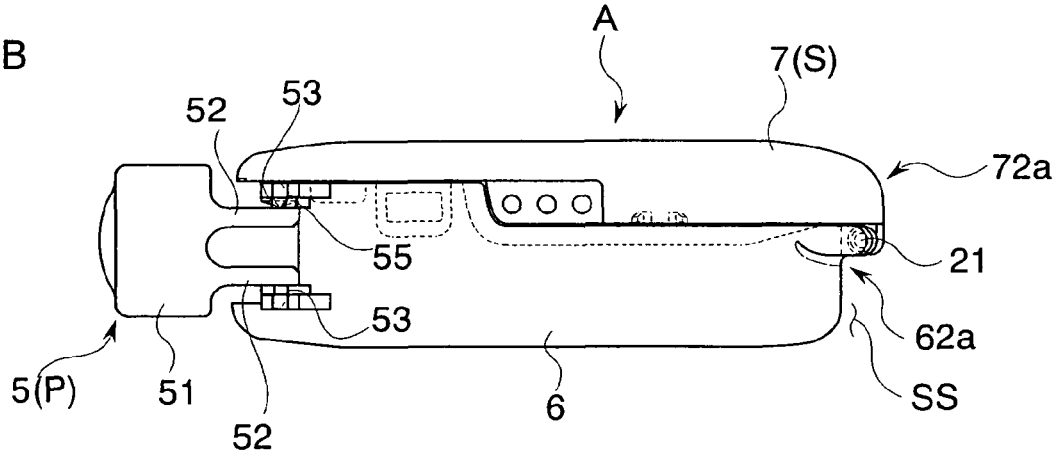
Figure 4C:
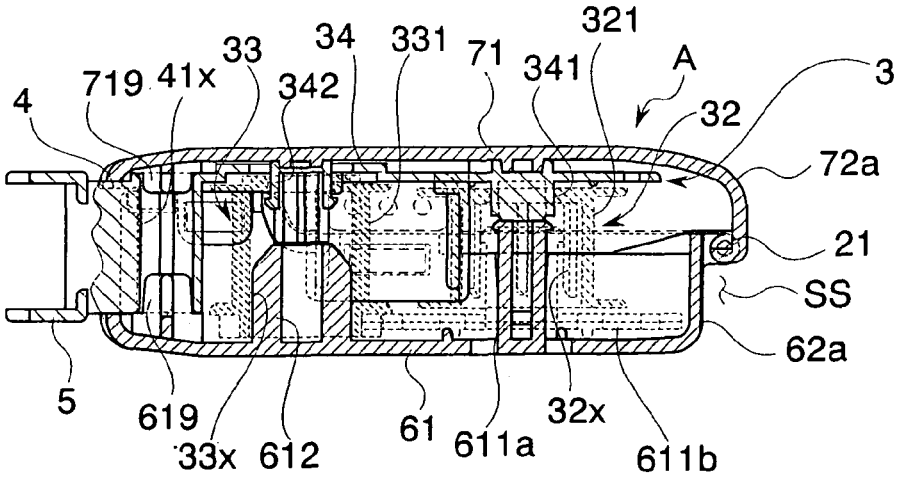

As shown in FIGS. 1 to 5, a transfer tool A according to the embodiment includes a transfer tool body 1 having a case portion 2 and a refill 3 which can hold the case portion 2, a transfer head 4 which is held by the transfer tool body 1, more specifically by the refill 3, and a head cap 5 which is pivotally attached to the transfer tool body 1, more specifically to the case portion 2. FIG. 1 is a perspective view of a state where the head cap 5 of the transfer tool A is disposed in a later-described close position P. FIG. 2 is a perspective view of a state where the head cap 5 of the transfer tool A is disposed in a later-described open position Q. FIG. 3 is an exploded perspective view of the transfer tool A. FIG. 4A is a side view of the transfer tool A, FIG. 4B is a bottom view of the transfer tool A, and FIG. 4C is a vertical sectional view taken along the center of the transfer tool A.

Parts constituting the transfer tool A will be explained below. In the following explanation, unless otherwise specified, "front" means a side where the transfer head 4 exists and "back" means a side opposite from the transfer head 4. An example of a transferring object is paste, or a correcting ink coating film or the like for correcting a character or a figure written or printed on a paper sheet or a film which is an object to be transferred.

As described above, the transfer tool body 1 includes the case portion 2 and the refill 3 which is detachably held in the case portion 2. The case portion 2 includes a first case 6, a second case 7 which pairs off with the first case 6, and a hinge 21 which connects the first and second cases 6 and 7 such that they can relatively move between a use position S and an open position O.

Figure 5:
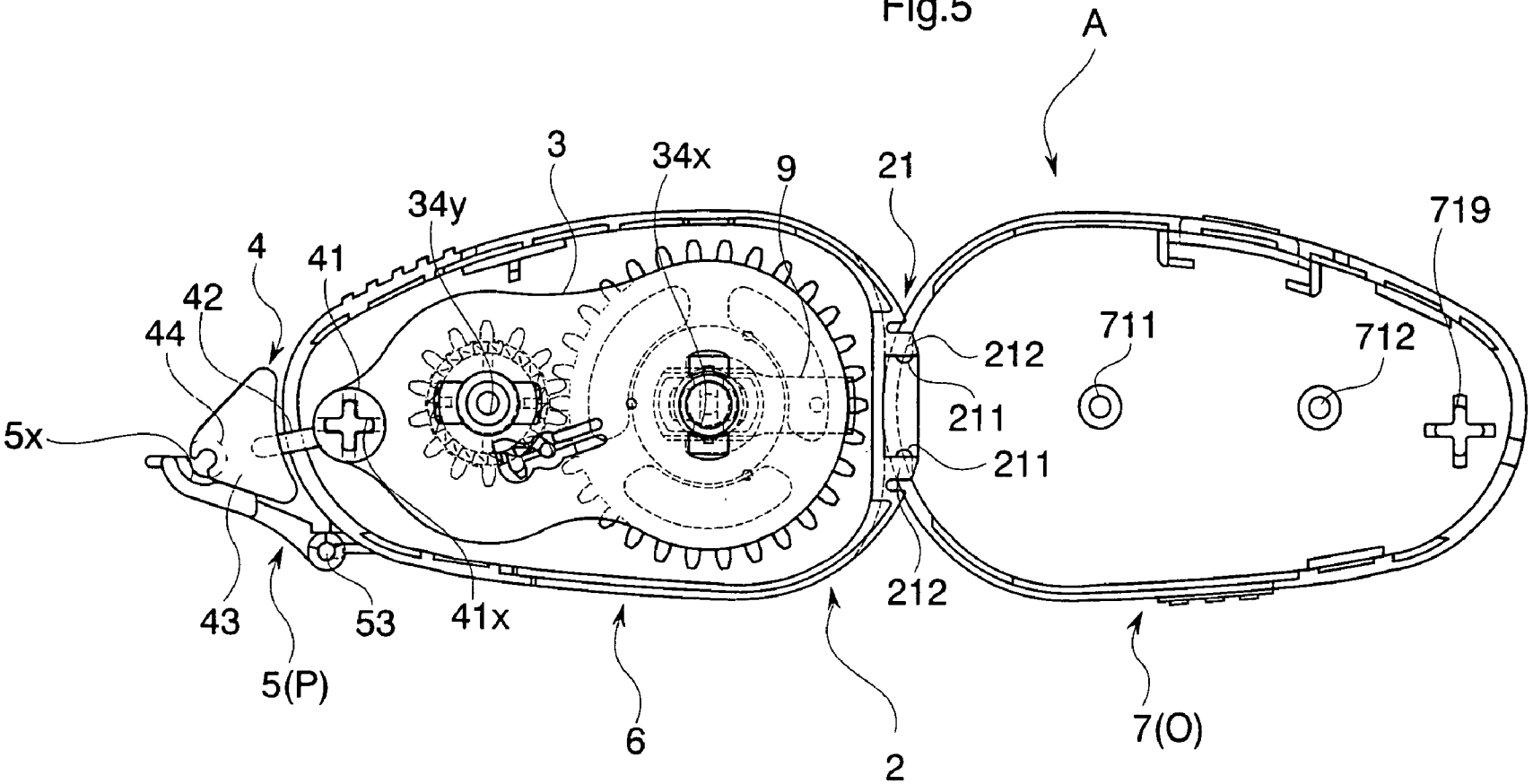
FIG. 5 is a side view of a state where first and second cases of the transfer tool of the embodiment are relatively moved to an open position.
Figure 6A:
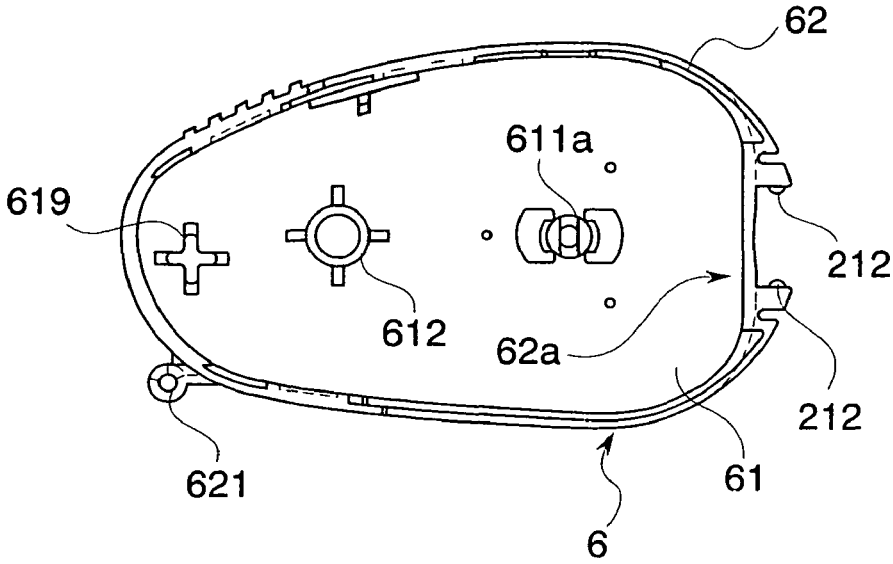
FIGS. 6A, 6B, and 6C are a side view, a bottom view and a central vertical sectional of the first case of the transfer tool of the embodiment, respectively.
Figure 6B:
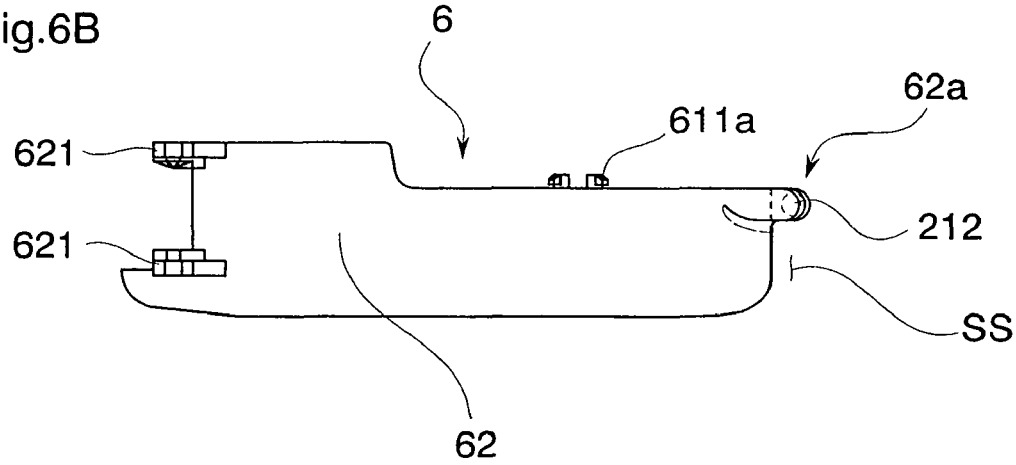
Figure 6C:
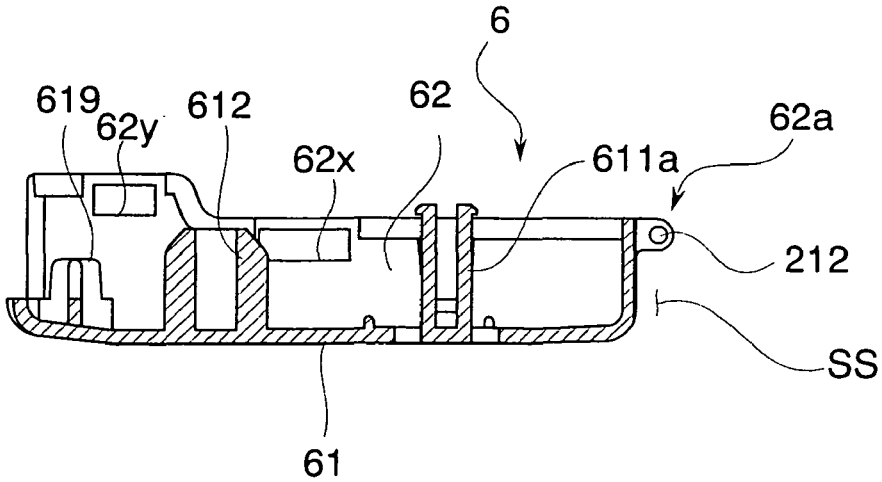

Constituent parts of the case portion 2 will be explained in more detail. As shown in FIG. 6, the first case 6 includes a main wall 61 forming a main body of the first case 6, and an outer wall 62 which is integrally formed on the main wall 61 and which surrounds the main wall 61. In the first case 6, a refill accommodation space S in which the refill 3 can be accommodated is formed. The refill accommodation space S is defined by the main wall 61 and the outer wall 62. FIG. 5 is a side view of a state where the first and second cases 6 and 7 of the transfer tool A of the embodiment are relatively moved to the open position O. FIGS. 1, 2 and 4 show a state where the first and second cases 6 and 7 are relatively moved to the use position S. FIG. 6A is a side view of the first case 6, FIG. 6B is a bottom view of the first case 6 and FIG. 6C is a sectional view taken along the center of the first case 6.

The main wall 61 is provided therein with a supply reel mounting portion 611 for rotatably mounting a supply reel 32 of the refill 3, and a winding reel mounting portion 612 for rotatably supporting a winding reel 33 of the refill 3. The supply reel mounting portion 611 includes a supply reel support portion 611*a* which can rotate together with the supply reel 32 if the supply reel support portion 611*a* is inserted into a later-described meshing hole (not shown) of the supply reel 32, and a drive gear 611*b* which is coaxially mounted on the supply reel support portion 611*a* through a slide mechanism (not shown). The winding reel mounting portion 612 is integrally formed from the main wall 61 into a substantially cylindrical shape, and the winding reel mounting portion 612 can be inserted into a later-described winding reel mounting hole (not shown) formed in a tip end of the winding reel 33.

The outer wall 62 projects from a portion of the outer edge of the main wall 61 except the front end. The rear end of the outer wall 62 is formed as a hinge corresponding portion 62*a* to provide the hinge 21 on the rear end of the outer wall 62. An outer peripheral surface of the hinge corresponding portion 62*a* is continuous with an outer peripheral surface of other portion of the outer wall 62. The transfer head 4 passes through a head-exposing opening and is exposed outside. The head-exposing opening is a portion where the outer wall 62 is not provided.

Figure 7A:
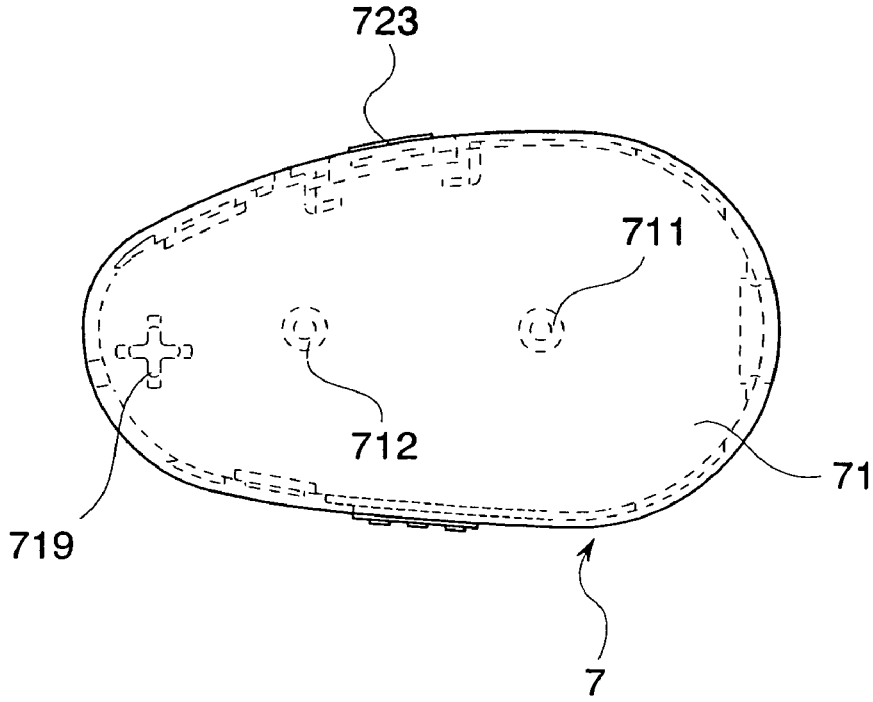
FIGS. 7A, 7B, and 7C are a side view, a bottom view and a central vertical sectional of the second case of the transfer tool of the embodiment, respectively.
Figure 7B:
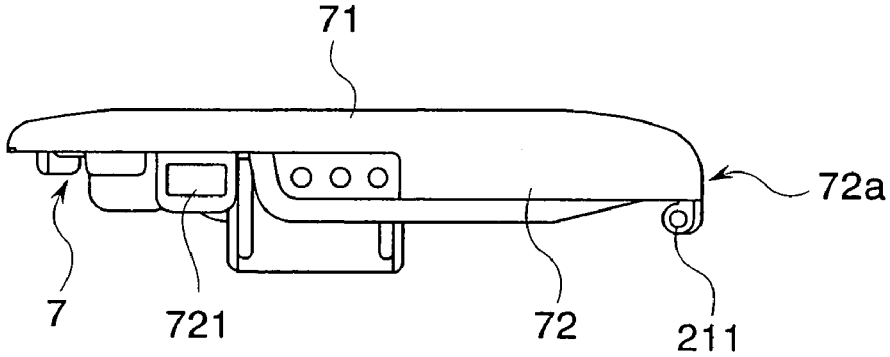
Figure 7C:
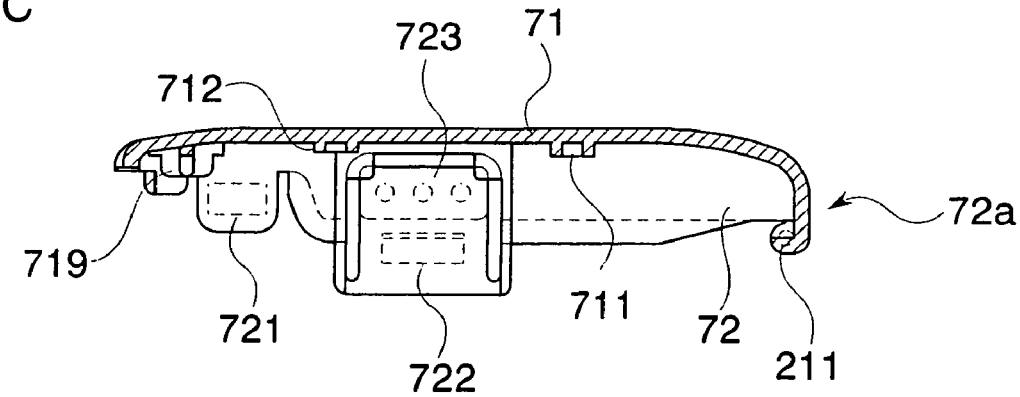

As shown in FIG. 7, the second case 7 includes a lid 71 which substantially closes the refill accommodation space S of the first case 6, and an outer wall 72 which projects from an outer edge of the lid 71 and its projecting end is overlapped on an outer wall 62 of the first case 6. FIG. 7A is a side view of the second case 7, FIG. 7B is a bottom view of the second case 7 and FIG. 7C is a vertical sectional view taken along the center of the second case 7.

The lid 71 is formed with insertion projections 711 and 712 which can be fitted into supported holes 34*x* and 34*y* formed in a support plate 34 at two locations corresponding to centers of the supply reel 32 and the winding reel 33.

To provide the hinge 21 on the rear end of the outer wall 72, the rear end of the outer wall 72 is formed as a hinge corresponding portion 72*a*. An outer peripheral surface of the hinge corresponding portion 72*a* is continuous with an outer peripheral surface of the other portion of the outer wall 72.

Front engaging part and rear engaging part are provided between the first case 6 and the second case 7 to realize a reliable engagement between the first and second cases 6 and 7. The front engaging part engages a front engaging recess 62*x* formed in a front portion of the outer wall 62 of the first case 6 and a front engaging pawl 721 provided on the outer wall 72 of the second case 7 at a location where a position thereof in the longitudinal direction matches with the front engaging recess 62*x* in the use position S with each other. The rear engaging part engages a rear engaging recess 62*y* provided at a central portion of the outer wall 62 of the first case 6 in the longitudinal direction and a rear engaging pawl 722 with each other. The rear engaging pawl 722 is provided on a portion of the outer wall 72 of the second case 7 which matches with the rear engaging recess 62*y* in the use position S in the longitudinal direction. The rear engaging pawl 722 can move between an engaging position where the rear engaging pawl 722 engages with the rear engaging recess 62*y* and a separating position where the rear engaging pawl 722 is separated from the rear engaging recess 62*y*. An operating portion 723 is provided near the rear engaging pawl 722. If the operating portion 723 receives an operating force, the rear engaging pawl 722 elastically deforms and moves from the engaging position to the separating position.

On the other hand, the hinge 21 connects the first and second cases 6 and 7 with each other such that the cases can relatively move between the use position S and the open position O as described above. In this embodiment, the hinge 21 is provided inward of the outer edge of the second case 7. More specifically, the hinge 21 is formed by utilizing a shaft member 211 projecting from the second case 7, and a pair of bearings 212 and 212 which are provided on the first case 6 and which pivotally support the shaft member 211 from both sides thereof. An evacuation space SS is provided near the hinge 21 of the first case 6, preferably in front of the bearings 212 and 212 for receiving the second case 7 in the close position Q.

The transfer tool A of the embodiment further includes a transmission mechanism which is provided between the first case 6 and the refill 3 for transmitting rotation of the supply reel 32 to the winding reel 33.

The refill 3 is held between the first case 6 and the second case 7. The refill 3 includes the supply reel 32 which holds an unused transfer tape in a state, the unused transfer tape being wounded on the supply reel 32 in the state, the winding reel 33 around which a used transfer tape film is wound, and a support plate 34 which rotatably supports the supply reel 32 and the winding reel 33 and which integrally holds the transfer head 4.

The transfer head 4 can transfer a transferring object provided on a transfer tape to an object to be transferred. In this embodiment, the transfer head 4 is supported by the refill 3, and the refill 3 and the transfer head 4 are integrally handled.

As shown in FIG. 4, the supply reel 32 includes a supply reel body 321 forming a main body of the supply reel 32, and a meshing hole 32*x* which can accommodate the supply reel 32 when a transfer tape is pulled out from the supply reel support portion 611*a* such that rotation of the supply reel 32 can be transmitted and the meshing hole 32*x* meshes with the supply reel support portion 611*a*.

As shown in FIG. 4, the winding reel 33 includes a winding reel body 331 forming a main body of the winding reel 33, a winding reel mounting hole 33*x* which can accommodate the winding reel mounting portion 612 such that the winding reel mounting hole 33*x* can rotate with respect to the winding reel mounting portion 63, and a follower gear 33*a* which is formed on a peripheral edge of the winding reel mounting hole 33*x* and which can mesh with the drive gear 611*b*. That is, in this embodiment, the supply reel support portion 611*a* and the drive gear 611*b* which constitute the supply reel mounting portion 611, and the follower gear 33*a* constitutes the transmitting mechanism.

As shown in FIG. 4, a front end of the support plate 34 supports a base end 41 of the transfer head 4 such that the base end 41 can not rotate. The support plate 34 is provided at its surface opposed to the first case 6 with a supply reel holding portion 341 and a winding reel holding portion 342 which rotatably hold the supply reel 32 and the winding reel 33, respectively. Supported holes 34*x* and 34*y* are formed in the surface of the support plate 34 opposed to the second case 7 at locations corresponding to centers of the supply reel 32 and the winding reel 33, respectively.

Figure 9A:
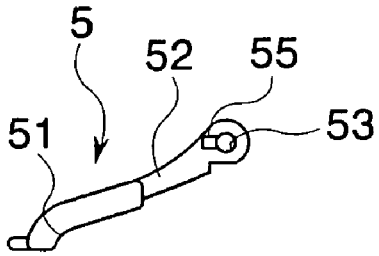
FIGS. 9A, 9B, 9C, and 9D are a right side view, a bottom view, a plan view and a left side view of the head cap of the embodiment, respectively.
Figure 9B:
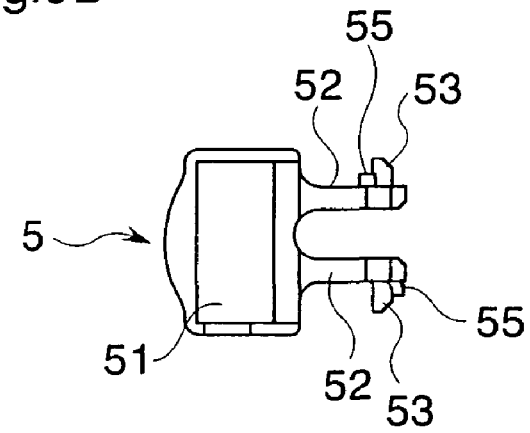
Figure 9C:
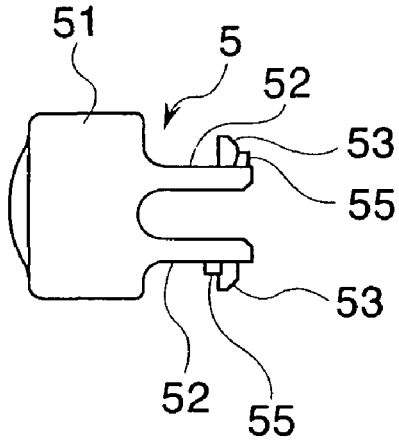
Figure 9D:
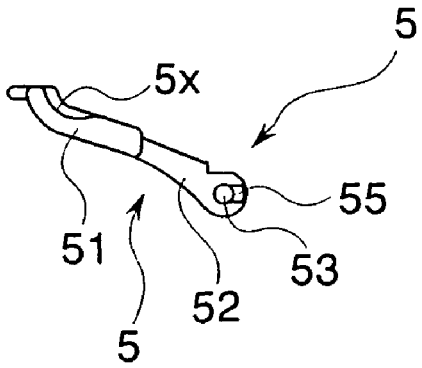
Figure 10A:
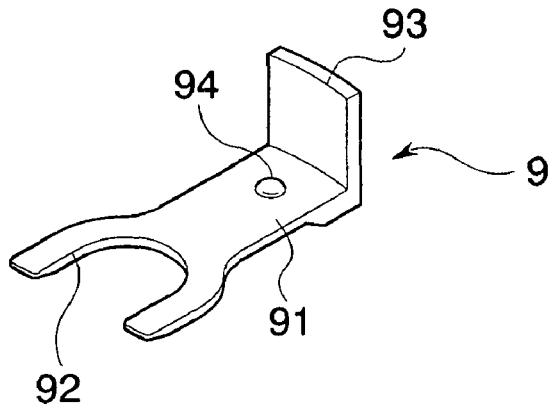
FIGS. 10A, 10B, 10C, and 10D are a perspective view, a front view, a side view and a plan view of a stopping member of the embodiment, respectively.
Figure 10B:
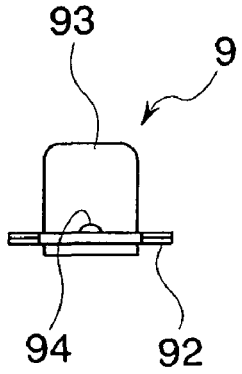
Figure 10C:
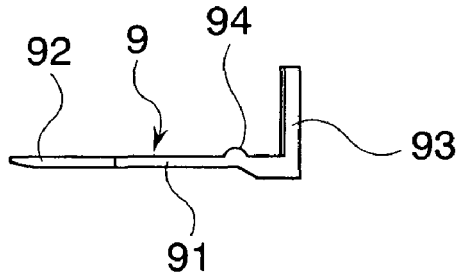
Figure 10D:
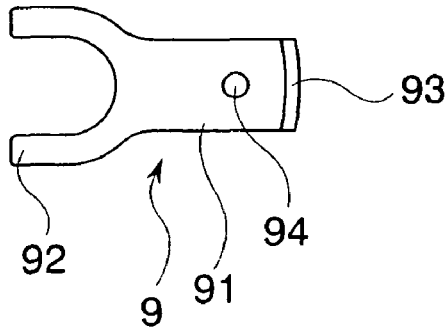

In addition, a stopping member 9 can be inserted and pulled out between the supply reel 32 and the support plate 34 to prevent the supply reel 32 from rotating when the refill 3 is transported alone. As shown in FIG. 10, the stopping member 9 includes a stopping body 91 inserted between the supply reel 32 and the support plate 34, an abutting portion 92 which is provided on one end of the stopping body 91 and which abuts against the supply reel support portion 611*a* of the first case 6 when the stopping member 9 is disposed to a predetermined inserting position, a knob 93 which is provided on the other end of the stopping body 91 and which projects toward the second case 7 in a state where the refill 3 is mounted on the first case 6, and a projection 94 which is provided on one surface of the stopping body 91 and which can be engaged with an engaging recess 34*z* formed in the support plate 34 when the stopping member 9 is disposed in the predetermined inserting position. FIG. 10A is a perspective view of the stopping member 9, FIG. 9B is a front view of the stopping member 9, FIG. 10C is a side view of the stopping member 9 and FIG. 10D is a plan view of the stopping member 9.

As shown in FIGS. 3 and 5, the transfer head 4 includes a base end 41 integrally formed on the support plate 34 of the refill 3, an extension plate 42 extending forward from the base end 41, restriction plates 43 and 43 formed on both sides of the extension plate 42 as outer plates, and a transfer roller 44 which is rotatably supported by tip ends of the restriction plates 43 and 43 as folding back guide portion. The base end 41 is set such that the base end 41 can slightly deform when the transfer head 4 which is being used is pressed in this embodiment. The restriction plates 43 and 43 are provided for stably moving the transfer tape while suppressing deviation of the transfer tape sideway and for transferring the transferring object to the object which is to be transferred. That is, a transfer tape passage is formed between the restriction plates 43 and 43. A surface of the transfer roller 44 is made of material which can elastically deform so as to press the transfer tape against the object to be transferred. An engaging portion which can prohibit the relative turning motion between the base end 41 and the case portion 2 (i.e., first case 6 and second case 7) is provided between the base end 41 of the transfer head 4, the first case 6 and the second case 7. This engaging portion is provided on the base end 41 of the transfer head 4, and engages a cross groove 41*x* opening in a width direction of the transfer tool A and cross ribs 619 and 719 provided on the first case 6 and the second case 7 with each other.

The head cap 5 is pivotally supported by the first case 6 through the pivot shaft 53. The head cap 5 can turn between the close position P where the head cap 5 can cover a tip end of the transfer head 4 and an open position Q where the tip end of the transfer head 4, i.e., at least the restriction plates 43 and 43 and the transfer roller 44 are exposed.

More specifically, as shown in FIG. 9, the head cap 5 includes a cap body 51 which is opposed to a lower surface of the restriction plate 43 of the transfer head 4 in the close position P (surface to be opposed to an object to be transferred) and which cover a tip lower end of the transfer head 4, connecting arms 52 extending from both end edges of the cap body 51, and a pivot shaft portion 53 which is provided on an end of the connecting arm 52 and which is pivotally supported on a cap receiver 621 provided on the outer wall 62 of the first case 6. The head cap 5 is located outside of an inserting and pulling out locus of the transfer head 4 when the head cap 5 is disposed in the close position P. In this embodiment, the inserting and pulling out locus of the transfer head 4 is a locus of the transfer head 4 from a position where the transfer head 4 which is integrally constituted with the refill 3 is mounted on the first case 6 to a position where it is moved by the longitudinal size of the supply reel mounting portion 611, i.e., a projecting width from the main wall 61 in the pulling out direction. That is, the head cap 5 has a shape which is not overlapped on the transfer head 4 as viewed from side in the pulling out direction when the head cap 5 is disposed in the close position P. In other words, the head cap 5 can form a head inserting and pulling out space so that the transfer head 4 can move in the inserting and pulling out direction of the transfer head 4 in the pulling out direction of the transfer head 4. The head cap 5 includes a head accommodating recess 5x in which the transfer roller 44 of the transfer head 4 can be accommodated when the head cap 5 is disposed in the close position P. FIG. 9A is a right side view of the head cap 5, FIG. 9B is a bottom view of the head cap 5, FIG. 9C is a plan view of the head cap 5 and FIG. 9D is a left side view of the head cap 5.

Figure 8A:
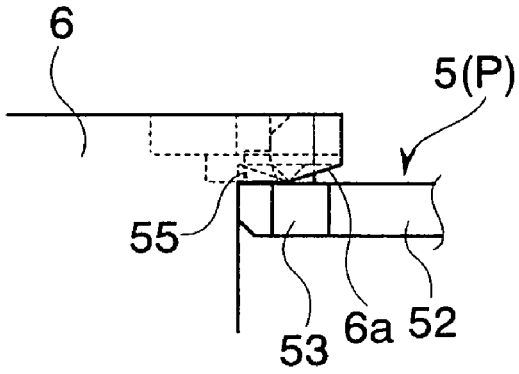
FIGS. 8A, 8B, and 8C are an explanatory diagram of function of the holding mechanism of the transfer tool of the embodiment, respectively.
Figure 8B:
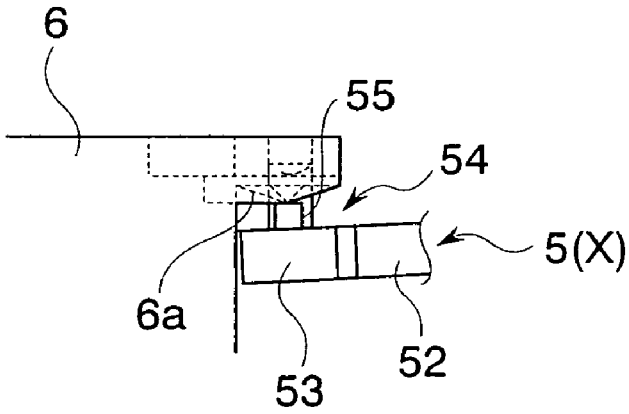
Figure 8C:
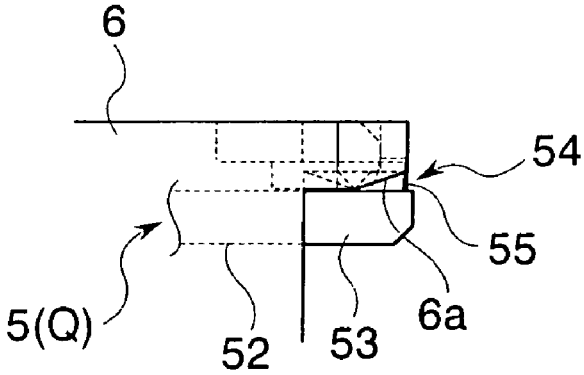

An urging mechanism 54 which selectively elastically urges the head cap 5 toward the close position P or the open position Q is provided in the vicinity of the pivot shaft portion 53 of the head cap 5. More specifically, as shown in FIG. 8, a projection 55 projects from the pivot shaft portion 53, and a cam face portion 6*a* which can slide on the projection 55 is provided adjacent to the bearing of the first case 6. The cam face portion 6*a* and the projection 55 slide on each other, the projection 55 and other connecting arm 52 provided on the pivot shaft portion 53 are elastically deformed, and they move toward the other connecting arm 52. The cam face portion 6*a* has only one dead point X at which a distance between the dead point X and the axis of the pivot shaft portion 53 becomes minimum and the moving amount of the connecting arm 52 becomes maximum when the head cap 5 is located at an intermediate location between the close position P and the open position Q. The cam face portion 6*a* urges the head cap 5 toward the close position P if the head cap 5 is closer to the close position P, and toward the open position Q if the head cap 5 is closer to the open position Q. FIG. 8A shows a state where the head cap 5 is disposed in the close position P, FIG. 8B shows a state where the head cap 5 is disposed at the dead point X, and FIG. 8C shows a state where the head cap 5 is disposed in the open position Q.

As described above, the transfer tool according to the present invention includes a transfer tool comprising a transfer head which has a folding back guide portion for folding and guiding a transfer tape and a pair of outer walls for supporting side ends of the folding back guide and in which a transfer tape passage is formed between the outer walls; a refill for holding at least the transfer head; a case capable of holding the refill such that the refill can be inserted into and pulled out from the case in one direction; and a head cap which is pivotally mounted on the case through a pivot shaft portion and rotatable between a close position where the transfer head is covered and an open position where the transfer head is exposed, wherein the head cap is located outside an inserting and pulling out locus of the transfer head when the head cap is disposed in the close position. Therefore, even when the head cap 5 is disposed in the close position P, since the head cap 5 is located outside the inserting and pulling out locus of the transfer head 4, it is possible to prevent the transfer head 4 and the head cap 5 from interfering with each other when the refill 3 is attached or detached. Thus, labor for retracting the head cap 5 toward the open position Q can be omitted. That is, it is possible to more easily mount the refill 3.

Since the transfer tool A has the urging mechanism 54 which elastically urges the head cap 5 toward the close position P, the head cap 5 can be elastically urged toward the close position P by the urging mechanism 54 and the head cap 5 can be held in the close position P. Therefore, in the transfer tool A, it is possible to prevent the transfer head 4 from being exposed outside immediately after the refill 3 is mounted on the case portion 2.

Since the urging mechanism 54 is provided near the pivot shaft portion 53 of the head cap 5, it is unnecessary to provide a constituent part of the urging mechanism 54 on the side of the transfer head 4, and it is possible to easily share the design of the transfer head 4 or the refill 3 with other type of transfer tools.

In addition, the head cap 5 includes the head accommodating recess portion 5X which can accommodate the transfer roller 44 of the transfer head 4 therein when the head cap 5 is disposed in the close position P. Therefore, if the transfer roller 44 is accommodated in the head accommodating recess portion 5X, it is possible to prevent the transfer roller 44 of the transfer head 4 and the head cap 5 from interfering with each other, and the head cap 5 and the transfer head 4 can be brought closer when the head cap 5 is disposed in the close position P. Therefore, it is possible to enhance the outward appearance of the head cap 5 and to reduce the entire transfer tool A having such a head cap 5 in size.

The present invention is not limited to the above-described embodiment.

For example, in the close position, a wall body which is overlapped on one of the outer walls that is located on the opposite side in the pulling out direction of the transfer head may be provided on the opposite side in the pulling out direction of the head cap. With this structure, the transfer head can be covered more effectively. In this case, a holding mechanism which holds the head cap in the close position and the open position may be provided between the case portion and the outer wall of the head cap.

It is not always necessary that the head cap is provided with the head accommodating recess portion which can accommodate the folding back guide portion for the transfer head.

It is possible to variously modify the invention in a range not departing from the subject matter of the present invention.

What is claimed is:

1. A transfer tool, comprising:

a transfer head which comprises a folding back guide portion for folding and guiding a transfer tape and a pair of outer walls for supporting side ends of the folding back guide and in which a transfer tape passage is formed between the outer walls;

a refill for holding at least the transfer head;

a case for holding the refill such that the refill is inserted into and pulled out from the case from a width direction of the transfer tool;

a head cap which is pivotally mounted on the case through a pivot shaft portion and rotatable between a close position where the transfer head is covered and an open position where the transfer head is exposed;

a head cap receiver provided on, and outwardly projected from, an outer wall of the case;

an engaging portion that prohibits a relative turning motion between a base end of the transfer head and the case, the engaging portion being provided between the base end of the transfer head and the case, wherein the engaging portion engages a cross groove opening in the width direction of the transfer tool, and cross ribs provided on a main wall of the case in the width direction of the transfer tool, the cross groove opening and the cross ribs being provided on the base end of the transfer head and the case, respectively, wherein the head cap is located outside an inserting and pulling out locus of the transfer head when the head cap is disposed in the close position, wherein the pivot shaft portion of the head cap is pivotally supported on the cap receiver, wherein the head cap does not overlap with the transfer head as viewed from a side in a pulling out direction of the transfer head when the head cap is disposed in the close position, wherein the transfer head further comprises:

a base end integrally formed on the refill;

an extension plate extending forward from the base end; and restriction plates formed on both sides of the extension plate as outer plates, and wherein the folding back guide portion is rotatably supported by tip ends of the restriction plates and presses the transfer tape against an object to be transferred; and an urging mechanism comprising a projection and a cam face portion, wherein the projection projects from the pivot shaft portion, wherein the cam face portion slides on the projection, the cam face portion being provided adjacent to a bearing which pivotally supports the pivot shaft portion, and wherein the urging mechanism urges the head cap by elastically deforming near a projection portion of the head cap when the cam face portion and the projection slide on each other.

2. The transfer tool according to claim 1, further comprising a holding mechanism for elastically urging the head cap toward the close position.

3. The transfer tool according to claim 2, wherein the holding mechanism is provided in a vicinity of the pivot shaft portion of the head cap.

4. The transfer tool according to claim 3, further comprising a head accommodating recess portion which accommodates the folding back guide portion of the transfer head when head cap is disposed in the close position.

5. The transfer tool according to claim 3, further comprising a wall body which is provided on an opposite side in a pulling out direction of the head cap and which is overlapped on one of the outer walls that is located on the opposite side in the pulling out direction of the transfer head.

6. The transfer tool according to claim 2, further comprising a head accommodating recess portion which accommodates the folding back guide portion of the transfer head when head cap is disposed in the close position.

7. The transfer tool according to claim 2, further comprising a wall body which is provided on an opposite side in a pulling out direction of the head cap and which is overlapped on one of the outer walls that is located on the opposite side in the pulling out direction of the transfer head.

8. The transfer tool according to claim 1, further comprising a head accommodating recess portion which can accommodate the folding back guide portion of the transfer head when head cap is disposed in the close position.

9. The transfer tool according to claim 8, further comprising a wall body which is provided on the opposite side in a pulling out direction of the head cap and which is overlapped on one of the outer walls that is located on an opposite side in the pulling out direction of the transfer head.

10. The transfer tool according to claim 1, further comprising a wall body which is provided on an opposite side in a pulling out direction of the head cap and which is overlapped on one of the outer walls that is located on the opposite side in the pulling out direction of the transfer head.

11. The transfer tool according to claim 1, wherein, in a plan view, said cap receiver is placed outside boundaries of the case.

12. The transfer tool according to claim 1, wherein the head cap comprises a cap body which is opposed to a lower surface of a restriction plate of the transfer head in the close position, said cap body covering a tip lower end of the transfer head.

13. The transfer tool according to claim 12, wherein the head cap further comprises connecting arms extending from both end edges of the cap body, said pivot shaft portion being provided on an end portion of the connecting arms.

14. The transfer tool according to claim , wherein the transfer head is integrally formed with the refill.

15. The transfer tool according to claim 1, wherein the base end is integrally formed on a support plate of the refill, and wherein the folding back guide portion comprises a transfer roller which rotatably supports the tip ends of the restriction plates.

16. The transfer tool according to claim 1, wherein the head cap provides a head inserting and pulling out space such that the transfer head moves in the pulling out direction of the transfer head.

17. The transfer tool according to claim 1, wherein, in the close position, the head cap is spaced apart from the transfer head.

18. The transfer tool according to claim 1, wherein the engaging portion engages the cross groove opening with the cross ribs in the width direction of the transfer tool.

19. The transfer tool according to claim 1, wherein the case comprises:

a first case;

a second case that pairs off with the first case; and a hinge which connects the first case with the second case such that the first case and the second case relatively move between the open position and the close position, wherein the cross ribs are provided on the first case and the second case.

20. The transfer tool according to claim 19, wherein, in the close position, the cross ribs of the first case and the second case engage with the cross groove opening in the width direction of the transfer tool.

* * * * *